US007954745B2

(12) United States Patent
Gingras

(10) Patent No.: US 7,954,745 B2
(45) Date of Patent: Jun. 7, 2011

(54) REFINER PLATE SEGMENT WITH TRIANGULAR INLET FEATURE

(75) Inventor: Luc Gingras, Lake Oswego, OR (US)

(73) Assignee: Andritz Inc., Glens Falls, NY (US)

( * ) Notice: Subject to any disclaimer, the term of this patent is extended or adjusted under 35 U.S.C. 154(b) by 291 days.

(21) Appl. No.: 11/773,246

(22) Filed: Jul. 3, 2007

(65) Prior Publication Data

US 2008/0041997 A1 Feb. 21, 2008

Related U.S. Application Data

(60) Provisional application No. 60/837,619, filed on Aug. 15, 2006.

(51) Int. Cl.
*B02C 13/30* (2006.01)

(52) U.S. Cl. ..... 241/261.3; 241/296

(58) Field of Classification Search ..... 241/261.3, 241/261.2, 298, 252, 251, 247, 248, 296, 241/297

See application file for complete search history.

(56) References Cited

U.S. PATENT DOCUMENTS

| | | | | | |
|---|---|---|---|---|---|
| 351,617 | A * | 10/1886 | Anderson | 241/247 |
| 647,511 | A * | 4/1900 | Newman | 241/100 |
| 730,631 | A * | 6/1903 | Fusmer | 241/251 |
| 1,226,032 | A * | 5/1917 | Van Nostrand | 241/251 |
| 1,392,464 | A * | 10/1921 | Thompson | 241/247 |
| 1,603,534 | A * | 10/1926 | Grafflin | 241/21 |
| 3,040,996 | A * | 6/1962 | Ginaven | 241/251 |
| 4,283,016 | A * | 8/1981 | Reinhall | 241/21 |
| 5,042,726 | A * | 8/1991 | Reinhall | 241/28 |
| 5,362,003 | A * | 11/1994 | Virving | 241/261.3 |
| 5,950,946 | A * | 9/1999 | Kjellqvist et al. | 241/261.2 |
| 7,191,967 | B2 * | 3/2007 | Vuorio et al. | 241/261.3 |
| 7,445,174 | B2 * | 11/2008 | Virving | 241/298 |
| 7,478,773 | B2 * | 1/2009 | Gingras et al. | 241/298 |
| 2002/0070303 | A1 * | 6/2002 | Johansson et al. | 241/261.3 |
| 2004/0118959 | A1 * | 6/2004 | Virving | 241/261.3 |
| 2006/0192040 | A1 * | 8/2006 | Johansson | 241/30 |
| 2008/0296419 | A1 * | 12/2008 | Gingras | 241/28 |

* cited by examiner

*Primary Examiner* — Faye Francis
(74) *Attorney, Agent, or Firm* — Nixon & Vanderhye P.C.

(57) ABSTRACT

A refiner plate for refining lignocellulosic materials has an injector inlet having a substantially triangular protrusion. The substantially triangular protrusion may feed the incoming lignocellulosic material into the refining zone and may distribute the material around the refining zone.

17 Claims, 7 Drawing Sheets

REFINER PLATE SEGMENT WITH TRIANGULAR INLET FEATURE

CROSS RELATED PATENT APPLICATION

This application claims the benefit of application Ser. No. 60/837,619, filed Aug. 15, 2006, which is incorporated in its entirety by reference.

BACKGROUND OF THE INVENTION

This disclosure generally relates to refiners and refiner plates for refining lignocellulosic materials, such as fibers and other substances containing cellulose and lignin. This disclosure generally relates to the inlet of a refiner plate, including refiner plates designed for use in disc refiners, conical refiners, and conical-disk refiners.

In high consistency mechanical pulp refiners, lignocellulosic materials—such as wood fibers—are worked between two relatively rotating surfaces on which refiner plates are mounted. The plates typically have radial bars and grooves. The bars provide impacts or pressure pulses which separate and fibrillate the fibers, and the grooves enable feeding of the fibers between the refiner discs. Typically, each refiner plate has a radially inner inlet zone which is adapted for receiving wood chips, previously refined fiber, and/or other lignocellulosic material and at least one radially outer refining zone.

The inlet zone generally feeds the incoming lignocellulosic material into the refining zone and distributes the material around the refining zone. In many conventional refiners, the inlet zone of the refiner plates generally either feeds well or distributes well. In feeding and distributing the lignocellulosic material, the refiner plate's inlet zone may perform an initial refining operation on the cellulosic material to reduce the size of the material.

A conical-disk refiner, for example, may have good feeding ability in the first zone, occasionally referred to as the "flat zone," as the centrifugal forces force the feed material along the gap created between two opposing refining plates. A second zone in a conical-disk refiner is the conical zone. In general, centrifugal forces normally project the feed material from the conical zone from the rotating element (which may be a smaller convex cone or plug) into the stationary element (which may be the larger concave element or shell). The feeding ability of the conical zone may not be as good as that of the flat zone. Accordingly, the conical zone may rely primarily on a forward flow of steam to promote forward movement of the pulp towards the refiner discharge which is typically located at the end of the conical zone or its larger diameter end.

A conical-disk refiner may generally lack significant mechanical centrifugal forces forcing the feed material from the discharge of the flat zone into the conical zone. Due to the absence of sufficient motive forces, the feed material may stall at the junction of the first and second zones. Stalling may potentially cause feed instabilities and other difficulties in operating the refiner, especially at higher production rates. In general, features on some conventional refiner plate designs may throw the fiber against the stator conical zone but may apply insufficient mechanical forces to feed forward the fiber along the gap between the conical zone rotor and stator.

An improved inlet section has been developed for refiners—such as conical, disk, and conical-disk refiners—and refiner plates for refining lignocellulosic material. In particular, an improved rotating element of a conical zone in a conical-disk refiner has been developed. The rotating element may improve feeding the lignocellulosic material forward from the junction of the flat and conical zones and may allow for a good distribution of the feed material around the rotating and stationary elements.

BRIEF DESCRIPTION OF THE INVENTION

In one embodiment, the invention may be used in a conical-disk refiner for refining lignocellulosic material. In other embodiments, the invention may be used in a conical refiner or a disk refiner.

In a conical-disk refiner, feeding the material from the junction of the flat and conical zones and into the conical zone may have certain design-related goals, one or more of which may be achieved in accordance with the present invention:

(1) In general, the inlet to the rotor conical zone preferably should be relatively open to ease the feed into the conical zone. It is preferable that approximately two-thirds of the chord length of the inlet of the conical zone be open so that feed may easily enter the conical zone.

(2) In general, the features at the inlet of the rotor conical zone preferably should impart a forward feeding mechanical force as the inlet contacts the feed material.

(3) In general, the rotor inlet features preferably should promote distribution of the feed material around substantially the entire surface of the rotor conical zone. Concentrating the feed in small concentrated areas of the inlet preferably avoided. This preference for a conical rotor may be less important than in a flat zone refiner, because the conical rotor typically expels the pulp into the stationary element, thus generally forcing a distribution of the feed.

(4) In general, the rotor inlet feature preferably should be designed to operate equally in both directions of rotation. Many users of this type of refiner may regularly change the operating direction of rotation. Changing the operating direction of rotation may extend the life of the refiner plates.

An inlet of the rotor conical zone preferably should operate against any standard inlet of a stator conical zone plate. The inlet should preferably have one or more substantially triangular protrusions at the inlet section. The protrusions may extend over the base level of the plate (which is defined by the bottom of the grooves in the outer section) and may reach a level substantially similar to the height of the bars from the refining section.

The substantially triangular shape of the protrusion is defined from an elevation view, where the base of the triangle is formed at the inlet of the rotor conical zone segment. The substantially triangular shape may also protrude a small amount beyond the inner portion of the base plate, preferably as much as the refiner geometry can allow without touching other surfaces is desired. The protrusion may reach into the gap separating the flat zone from the conical zone. The apex of the triangle may generally point radially outwards towards the outer periphery of the rotor conical zone segment. The sides of the triangles may create "forward feeding" surfaces that may generally impart a force vector on the feed material, helping propel the feed material forward towards the outer part of the conical zone.

The base of the triangular section of the feeding protrusion preferably covers approximately one-third of the arc length of the segment (or approximately one-sixth when 2 protrusions are used). For example, the range for the protrusions may cover 20% to 45% of the arc length of the segment inlet, and all sub-ranges therebetween. The slope of the sides of the triangles relative to a centerline passing through the middle of the triangle and aligned from the inlet of the segment to the periphery of the segment may preferably be in the range of 20° to 75°, and more preferably between 30° and 60°, and all sub-ranges therebetween. The lower corners of the segment may be sharp or, alternatively, may be slightly rounded off in order to minimize the likelihood of being easily chipped off or damaged by contraries that can be found in the feed material. Preferably, there is a positively feeding vector in the part of the triangle that extends beyond the limit of the refiner segment itself to help propel the feed material from the junction of the flat and conical gaps and into the conical gap. The apex of the triangle is preferably rounded for preventing chipping off the sharp edge, but also because a rounded off tip may promote the distribution of the feed around the rotor surface.

The substantially triangular protrusion may have a radius that may be substantially parallel with the base of the plate. Alternatively, the radius may not be substantially parallel with the base of the plate. The limit on the size of the radius is generally dictated only by practical constraints and considerations.

For example, it is preferable to maintain the feed angle at the inlet of the triangle within the range of 15-75°, and it is preferable to maintain a strong enough construction to avoid a feeding element that is structurally weak and may break in the refiner. In addition, the draft angle, or the side angle on the triangles relative to the axis running from the center of the refiner disk and across the base plate, should preferably—though not necessarily—be as close to 0° as possible, subject to limitations inherent in the manufacturing process. If a negative draft angle can be achieved cost-efficiently in the manufacturing process (the casting process typically demands a positive draft angle, so additional machining or the use of mold cores may be necessary), the negative draft angle would be preferable because it would increase the positive feeding effect by reducing the tendency to throw material into the stator side.

The substantially triangular protrusion may be approximately an equilateral triangle, an isosceles triangle, or a scalene triangle. The substantially triangular protrusion may have all acute angles, two acute angles and an obtuse angle, or two acute angles and a right angle. A substantially isosceles triangular protrusion is preferable due to its symmetry, which thus may permit reversal of the direction of rotation without substantially altering the refiner plate's performance.

In other embodiments, the substantially triangular protrusion located in a refiner plate's inlet may be used in a conical refiner or a disk refiner.

A refiner plate has been developed for refining lignocellulosic material. The refiner plate comprises a refining zone and an inlet zone. The inlet zone comprises at least one substantially triangular protrusion having three angles. Preferably, each of the angles at the base of the triangle is between 15° and 75°. The refiner plate may be a rotor or stator plate in any refiner for refining lignocellulosic material, including, for example, a conical-disk refiner, a disk refiner, or a conical refiner.

DETAILED DESCRIPTION OF THE INVENTION

Figure 1:
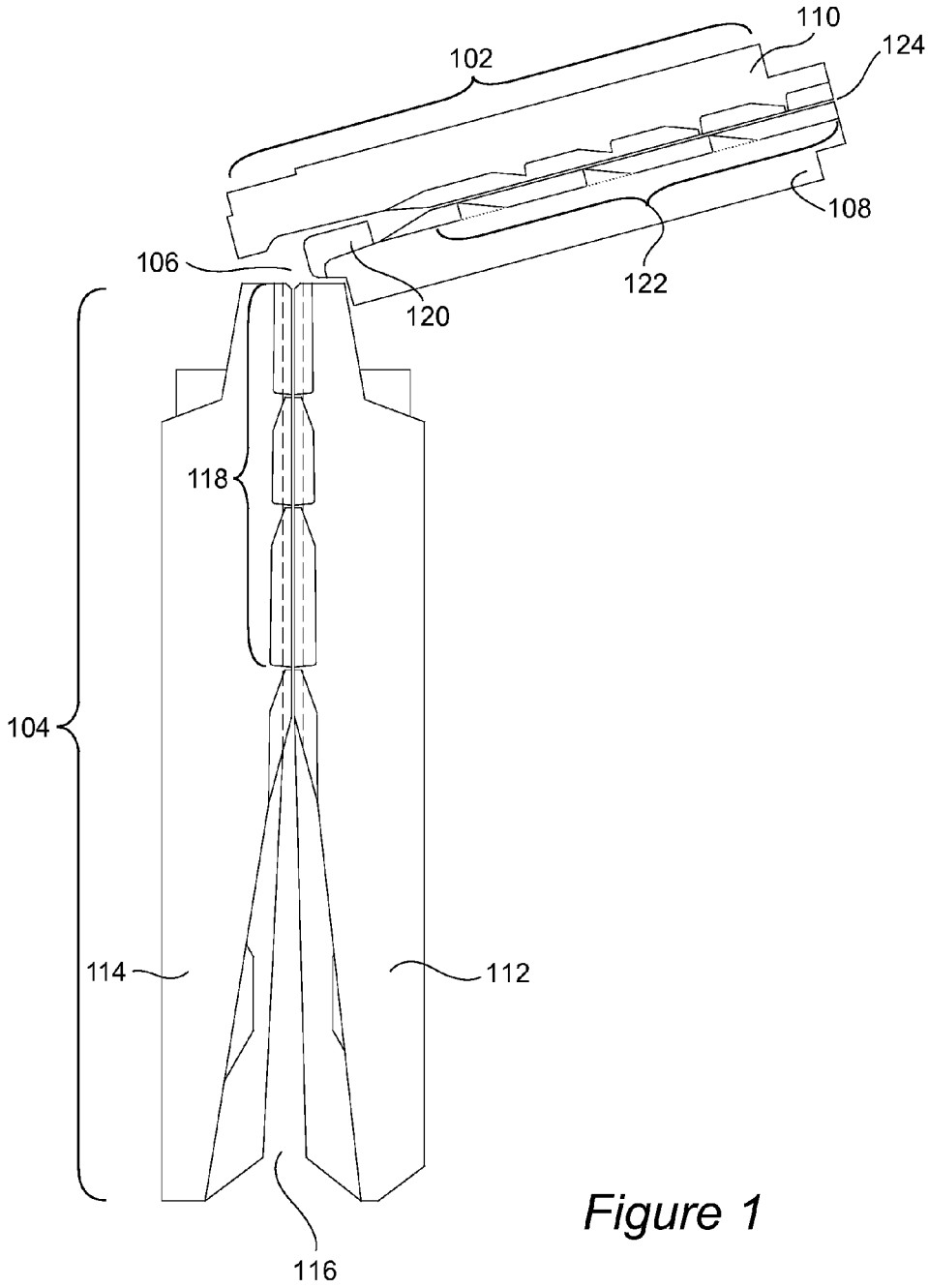
FIG. 1 is an illustration of a conical-disk refiner showing the refiner plates for the flat section and the conical section.

FIG. 1 illustrates a partial cross-sectional view of the configuration of refiner plates in a conical-disk refiner. There are two refining sections: conical section 102 and flat section 104. There is a gap 106 between conical section 102 and flat section 104 where the feed transitions from one refining zone to the next. Conical section 102 contains a rotor plate 108 and a stator plate 110. Flat section 104 similarly has a rotor plate 112 and a stator plate 114.

In general terms, lignocellulosic material enters the flat section at entrance 116. From there, the lignocellulosic material enters refining zone 118. Refining zone 118 contains a pattern of bars and grooves, which provide impacts or pressure pulses to facilitate separation and fibrillation of the fibers. As the lignocellulosic material is worked between the plates, steam may be generated.

From refining zone 118, the lignocellulosic material flows through the gap 106 to the injector inlet 120 of rotor plate 108 in conical section 102. The feed zone forces the lignocellulosic material forward and distributes the material amongst the refining section 122, which contains a pattern of bars and grooves to provide impacts or pressure pulses to facilitate separation and fibrillation of the fibers. After being worked between the rotor 108 and stator 110 in refining zone 122, the refined lignocellulosic material exits at exit 124.

Figure 2A:
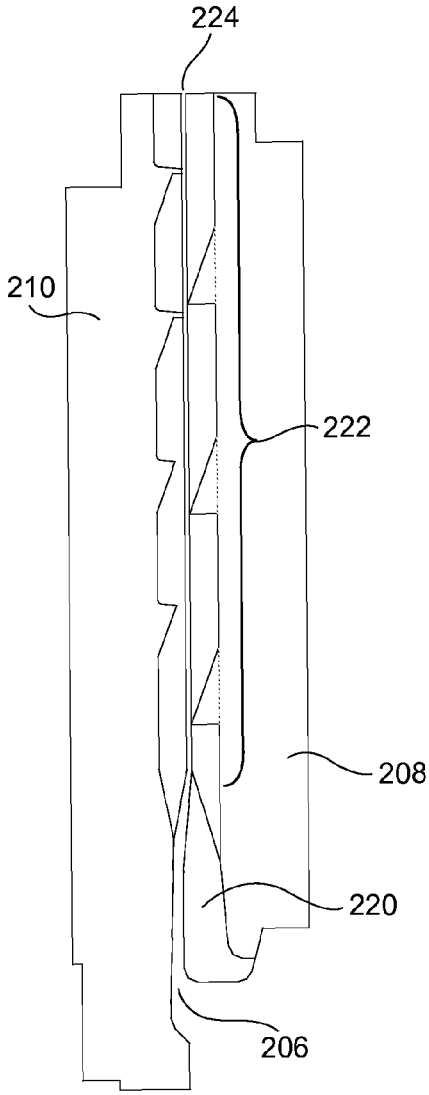
Figure 2A (Prior Art)
FIGS. 2A-C are illustrations of a prior art refiner plate for the conical section of a conical-disk refiner.
Figure 2C:
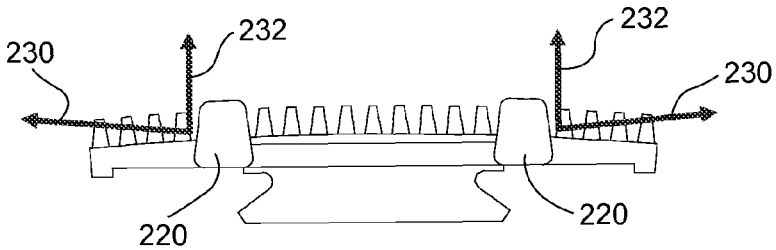
Figure 2C (Prior Art)
Figure 2B:
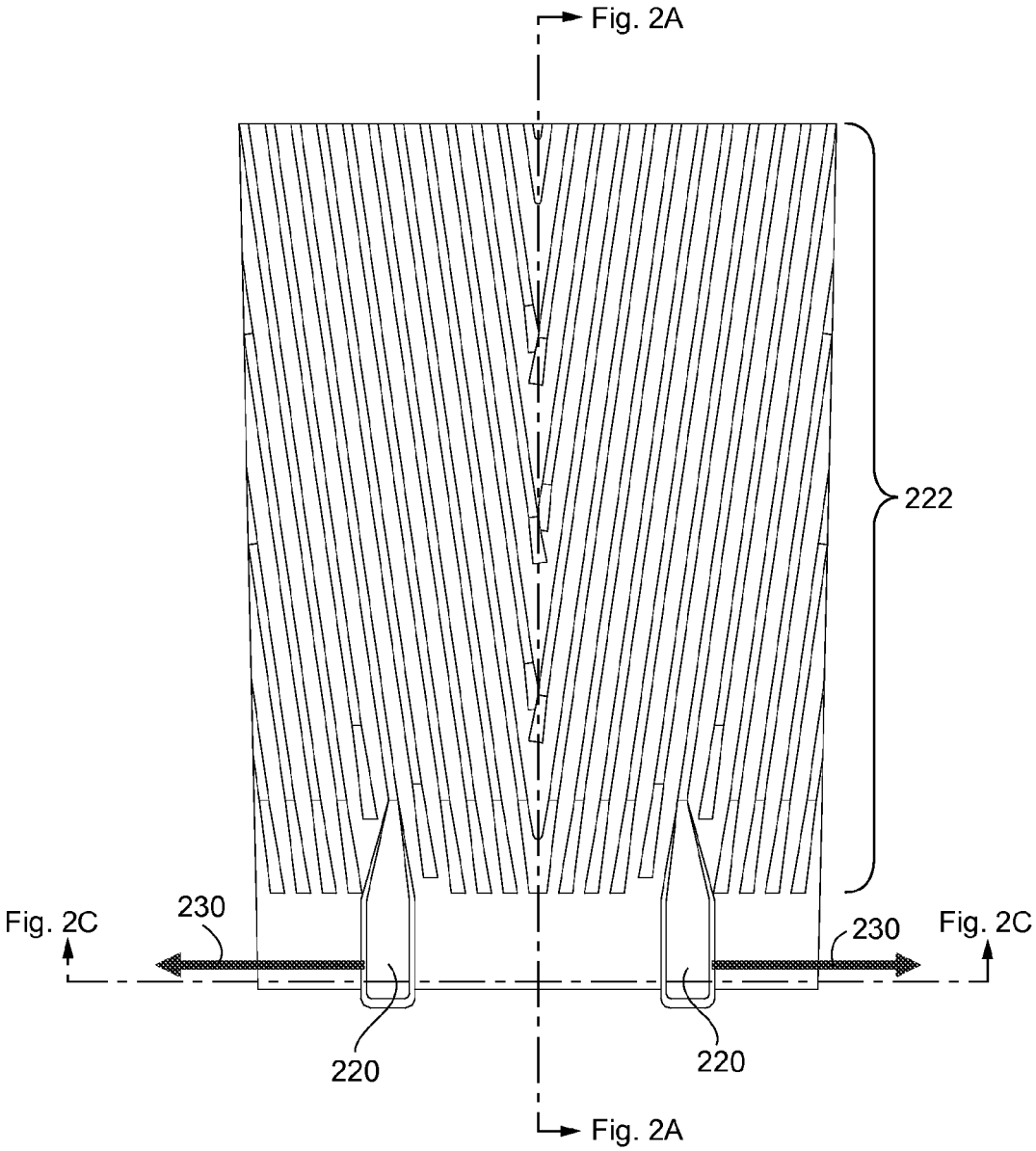
Figure 2B (Prior Art)

FIGS. 2A, 2B, and 2C show a prior art configuration of an inlet in a rotor plate in a conical section of a conical-disk refiner. FIG. 2A shows a cross-sectional view of A-A of FIG. 2B. FIG. 2C shows a cross-sectional view of C-C of FIG. 2B. In these figures, the same items share the same numbers.

In FIG. 2A, the lignocellulosic material flows from the gap 206 to the injector inlet 220 of rotor plate 208. The feed zone forces the lignocellulosic material forward and distributes the material amongst the refining section 222, which contains a pattern of bars and grooves to provide impacts or pressure pulses to facilitate separation and fibrillation of the fibers. After being worked between the rotor 208 and stator 210 in refining zone 222, the refined lignocellulosic material exits at exit 224.

FIG. 2B shows an overview of a prior art configuration of an inlet in a rotor plate in a conical section of a conical-disk refiner. The inlet protrusions 220 have an approximately square base with a triangular portion pointed toward refining section 222. The inlet protrusions 220 cause frictional forces 230. FIG. 2C shows inlet protrusions 220 and frictional forces 230 and centrifugal forces 232. Although it is believed that the frictional and centrifugal forces, as shown in FIGS. 2B and 2C, are more or less accurate, they are shown for illustrative purposes only.

Figure 3A:
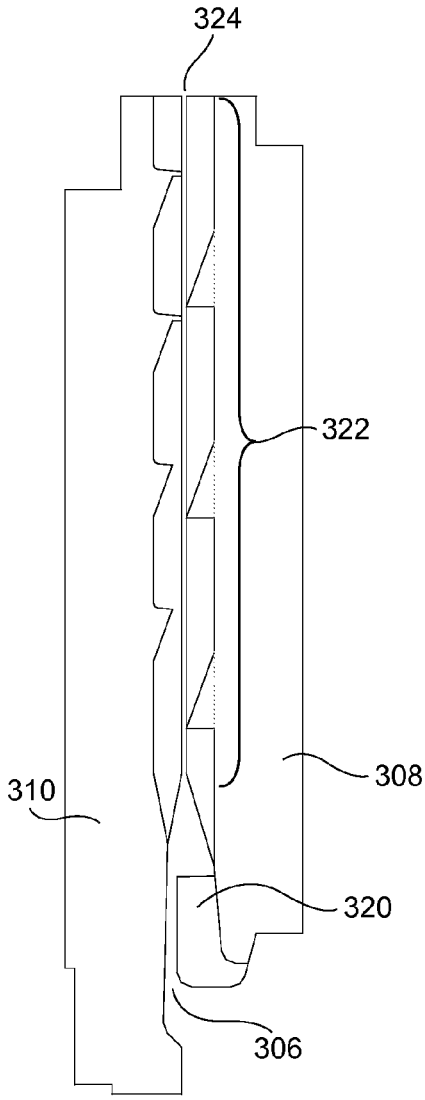
FIGS. 3A-C are illustrations of an embodiment of a refiner plate having a triangular injector inlet in a conical-disk refiner.
Figure 3C:
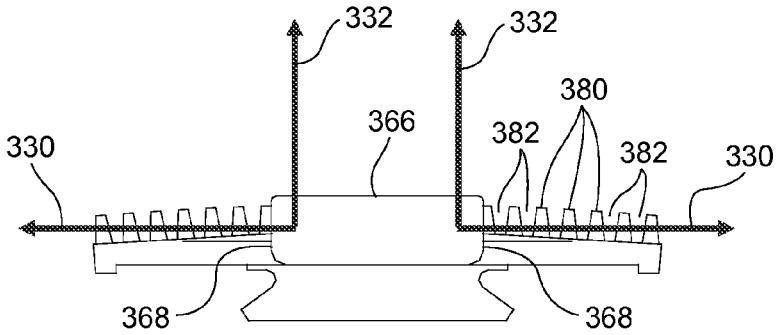
Figure 3B:
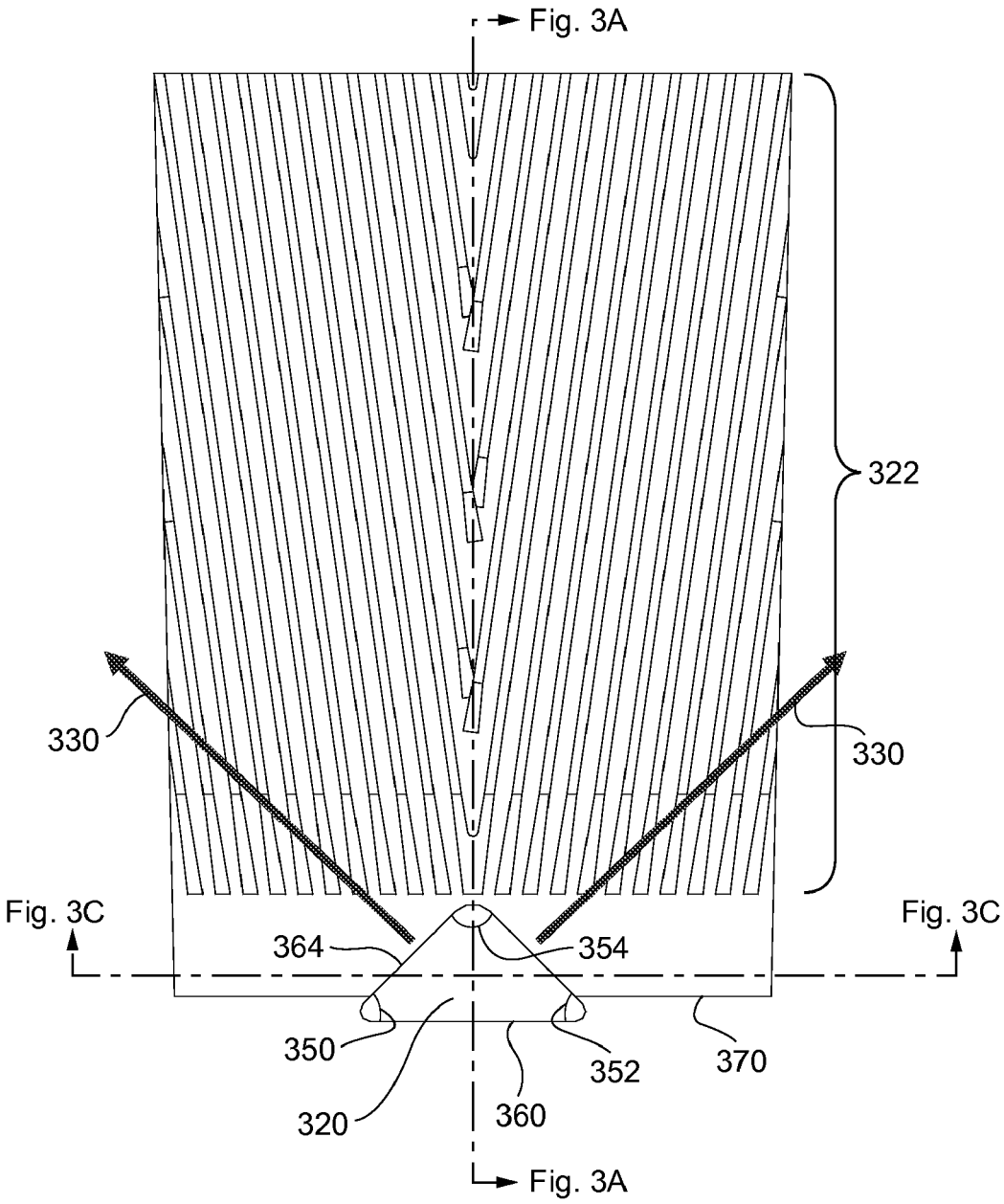

FIGS. 3A, 3B, and 3C show an embodiment of an inlet having a substantially triangular protrusion in a rotor plate in a conical section of a conical-disk refiner. Although shown in an embodiment related to the conical section of a conical-disk refiner, an inlet having a substantially triangular protrusion may be employed in a flat section of a conical-disk refiner, in a disk refiner, or in a conical refiner. Similarly, an inlet having a substantially triangular protrusion may be employed in either a rotor plate or a stator plate, even though depicted with respect to a rotor plate in the conical section of a conical-disk refiner.

FIG. 3A shows a cross-sectional view of A-A of FIG. 3B. FIG. 3C shows a cross-sectional view of C-C of FIG. 3B. In these figures, the same items share the same numbers.

In FIG. 3A, the lignocellulosic material flows from the gap 306 to the injector inlet 320 of rotor plate 308. The feed zone forces the lignocellulosic material forward and distributes the material amongst the refining section 322, which contains a pattern of bars and grooves to provide impacts or pressure pulses to facilitate separation and fibrillation of the fibers. The precise pattern of bars and grooves is unimportant to the present invention, and any conventional or nonconventional pattern is sufficient, so long as commercially practical and/or technically feasible. After being worked between the rotor 308 and stator 310 in refining zone 322, the refined lignocellulosic material exits at exit 324.

FIG. 3B shows an overview of an embodiment configuration of an inlet having a substantially triangular protrusion in a rotor plate in a conical section of a conical-disk refiner. As shown, there are a refining zone 322 and an inlet zone containing the substantially triangular inlet protrusion 320. The substantially triangular inlet protrusion 320 has a base 360, side 362, and side 364. In alternative embodiments, there are two or more substantially triangular inlet protrusions on the refiner plate.

Preferably, the base 360 and the sides 362 and 364 are substantially straight as depicted in the embodiment shown in FIG. 3B, although greater amounts of deviation from substantially straight are permitted in other embodiments. For example, they may be individually or collectively arcuate, jagged, or some other curvilinear form. As shown, the base 360 preferably extends beyond plate's base 370, although the base 360 may terminate in the same plane of the termination of base 370. Alternatively in a separate embodiment, base 370 may extend beyond base 360 of the substantially triangular protrusion. In FIG. 3B, the base 360 is substantially parallel to the base 370. In other embodiments, the base 360 is not substantially parallel to the base 370.

In an embodiment, the base of the triangular section of the feeding protrusion may preferably cover approximately one-third of the arc length of the segment (or approximately one-sixth when two protrusions are present). For example, the range for the total length of bases for all protrusions may cover 20 to 45%, preferably 25 to 40%, and more preferably 30-35% of the arc length of the segment inlet, and all sub-ranges therebetween.

As shown in FIG. 3B, the substantially triangular shape has three angles: angle 350, angle 352, and angle 354. These angles correspond to the three corners of the substantially triangular shape. As shown in FIG. 3B, angles 350 and 352 are approximately equivalent, forming an approximately isosceles triangular protrusion. In other embodiments, the substantially triangular protrusion 320 may be a substantially equilateral triangular protrusion or a substantially scalene triangular protrusion. One of angles 350, 352, and 354 may approximately be a right angle.

Preferably, angles 352 and 350 are between 15° and 75°, more preferably between 30° and 60°, and even more preferably between 40° and 50°, and all sub-ranges therebetween. As shown in FIG. 3B, the corners corresponding to each of angles 350, 352, and 354 are preferably substantially rounded. It is believed that rounding the corners minimizes the likelihood of being chipped or damaged by contraries in the feed material. In other embodiments, the angles are not substantially rounded.

Preferably, the feed angle at the inlet of the triangle is within the range of 15-75°, and it is preferable to maintain a strong enough construction to avoid a feeding element that is structurally weak and may break in the refiner. In addition, the draft angle, or the side angle on the triangles relative to the axis running from the center of the refiner disk and across the base plate should preferably—though not necessarily—be as close to 0° as possible, subject to limitations inherent in the manufacturing process. In fact, a negative draft angle is preferable because it would increase the positive feeding effect by reducing the tendency to throw material into the stator side.

In FIG. 3B, angle 354 corresponds to the apex of the substantially triangular shape 320. In some embodiments, the apex may protrude, either substantially or not, into the refining zone. As shown in FIG. 3B, the apex does not protrude into refining zone 322.

As shown in FIG. 3B, the substantially triangular inlet protrusion 320 causes frictional forces 330. FIG. 3C shows the substantially triangular inlet protrusion 320 and frictional forces 330 and centrifugal forces 332. Although it is believed that the frictional and centrifugal forces, as shown in FIGS. 3B and 3C, are more or less accurate, they are shown for illustrative purposes only. However, it should be noted that the present invention is not limited to the direction or magnitude of any particular frictional or centrifugal force.

FIG. 3C depicts a pattern of bars 380 and grooves 382. The top 366 of the substantially triangular protrusion is depicted as taller than the grooves. In other embodiments, the top 366 may be substantially the same height as bars 380 (or some subset of bars 380). In yet further embodiments, the top 366 may be shorter than bars 380 (or some subset of bars 380).

As shown in FIG. 3C, the substantially triangular protrusion 320 has a substantially rectangular cross-section formed by top 366 and sides 368 with rounded corners. In other embodiments, the substantially triangular protrusion 320 has a substantially trapezoidal—either isosceles or not—cross-section. In yet further embodiments, the substantially triangular protrusion does not have rounded corners.

Figure 4:
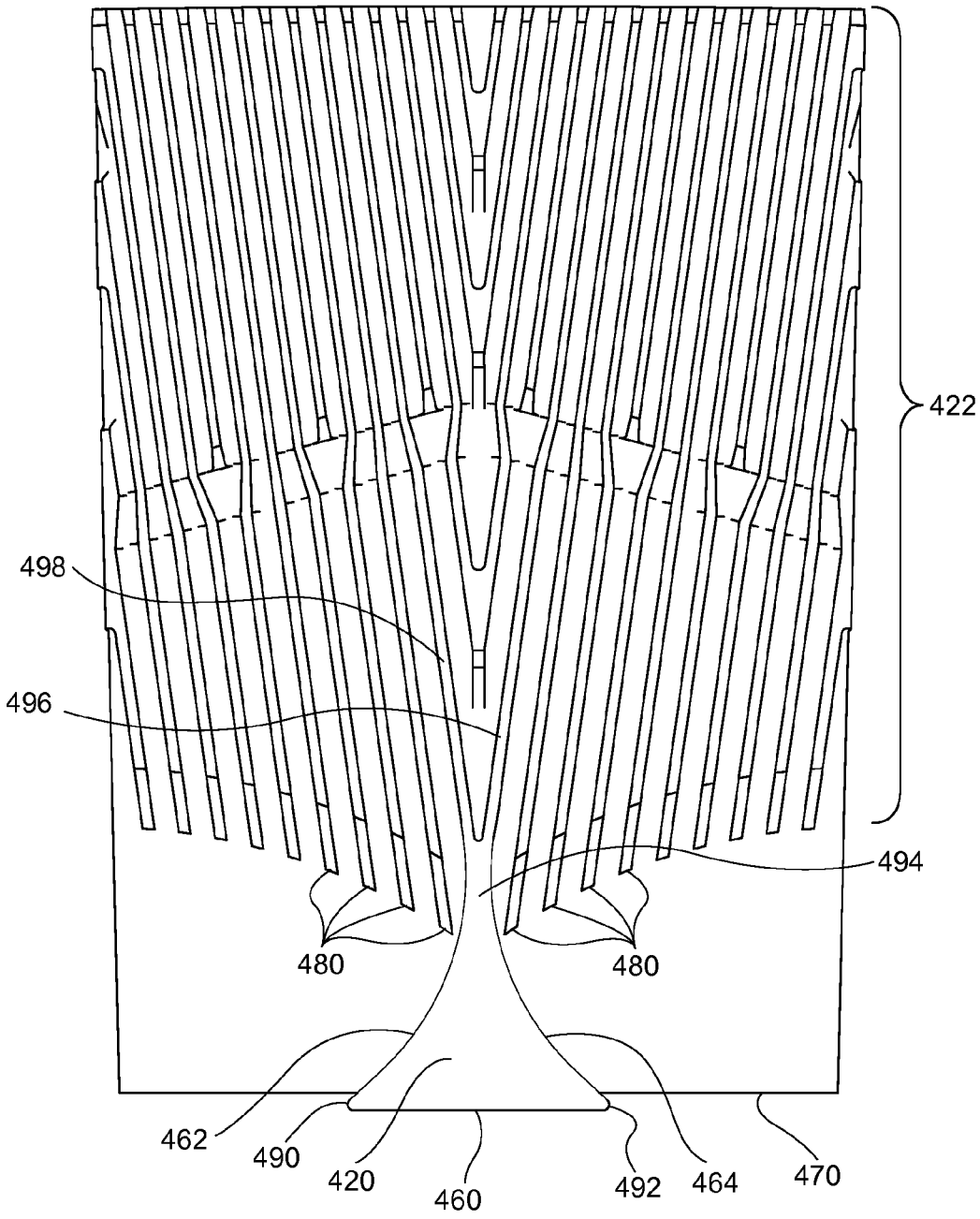
FIG. 4 is an illustration of another embodiment of a refiner plate having a triangular injector inlet.

FIG. 4 shows another embodiment of an inlet of a refiner plate having a substantially triangular protrusion. The refiner plate's feed zone forces the lignocellulosic material forward and distributes the material amongst the refining section 422, which contains a pattern of bars and grooves to provide impacts or pressure pulses to facilitate separation and fibrillation of the fibers. Some of the refining bars are labeled as 480. The precise pattern of bars and grooves is unimportant to the present invention, and any conventional or nonconventional pattern is sufficient, so long as commercially practical and/or technically feasible. In the embodiment shown in FIG. 4, the bars 480 are substantially parallel, and the inlets of the bars are arcuate from the centerline of the plate to the left and right edges of the plate. Whether the inlets of the bars 480 form an arc or some other configuration is generally a design choice based on operational considerations, such as composition of the lignocellulosic material, refiner capacity, refiner type, etc.

As shown in the embodiment of FIG. 4, the substantially triangular protrusion 420 has three sides: base 460, side 462, and side 464. Base 460, which is substantially straight, protrudes beyond the plate's base 470. In other embodiments, base 460 is not substantially straight. For example, the base of the substantially triangular protrusion may be arcuate, jagged, or some other curvilinear form. Sides 462 and 464 are generally arcuate, though they also may be substantially straight, jagged or some other curvilinear form. Furthermore, sides 462 and 464 may form an arc that bows outwardly from the center of the substantially triangular protrusion, rather than inwardly as depicted.

Side 462 and base 460 meet at corner 490. As shown, corner 490 is slightly rounded, although it may be more or less rounded in other embodiments. As depicted in this embodiment, the substantially triangular protrusion has an apex 494 that protrudes into refining zone 422. Furthermore, apex 494 does not form a corner; rather, apex 494 transitions into multiple refining bars: refining bar 496 and refining bar 498. In other embodiments, apex 494 transitions into a single refining bar or into more than two refining bars.

The transition, if any, from the substantially triangular protrusion into a refining bar may be relatively smooth or disjointed. That is, the surface of the refining bars 496 and 498 may not be in substantially the same plane as the surface of the substantially triangular protrusion 420. And if they are not in the same plane, the transition between the refining bars and the substantially triangular protrusion may be gradual or sudden.

Figure 5:
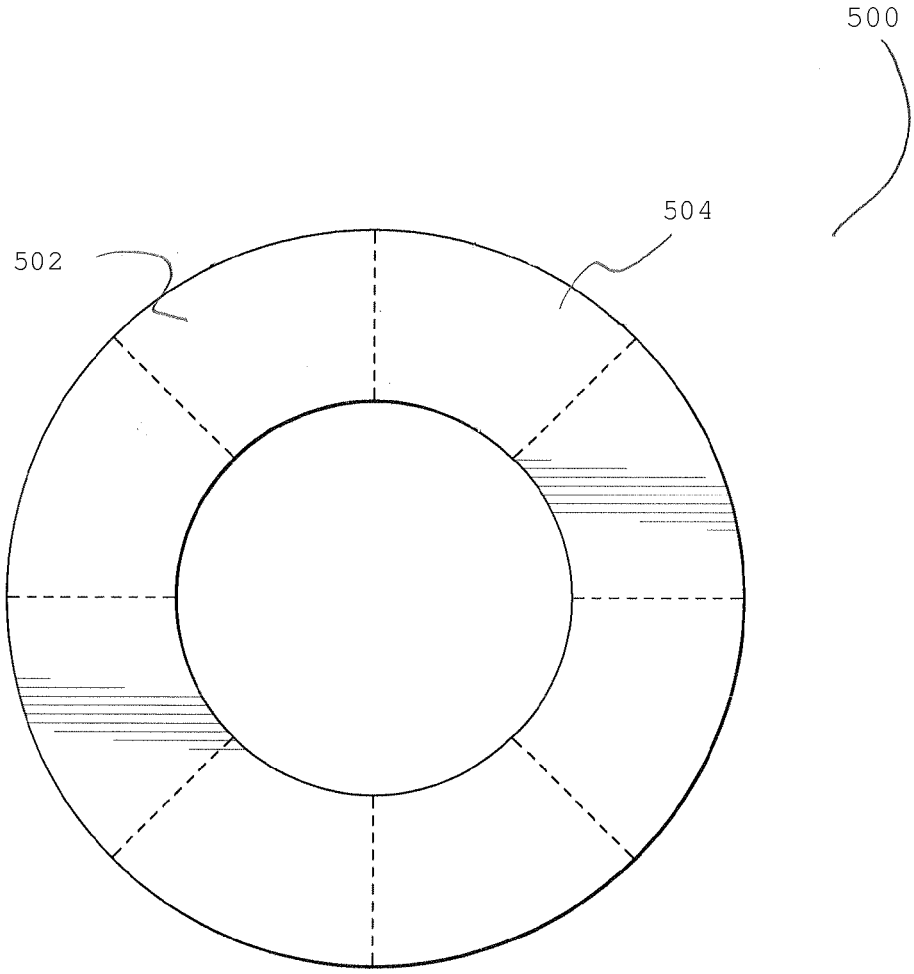
FIG. 5 is an illustration of an annular array of plate segments, each of which may have a triangular injector inlet (not shown).

Although FIG. 4 depicts a single substantially triangular protrusion 420, a single refiner plate may contain multiple substantially triangular protrusions in accordance with other embodiments FIG. 5 illustrates refiner plate 500 that includes an annular array of plate segments, such as plate segments 502 and 504. Each of the plate segments may have a triangular injector inlet (not shown).

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A refiner plate for refining lignocellulosic material comprising: a refining zone, and an inlet zone, wherein the inlet zone includes at least one substantially triangular protrusion consisting of a top and three sides: a base, a first side, and a second side, wherein the at least one substantially triangular protrusion is defined from an elevation view, wherein the at least one substantially triangular protrusion has a first rounded corner at a connection of the base and the first side, a second rounded corner at a connection of the base and the second side, and a third rounded corner at a connection of the first side and the second side.

2. The refiner plate of claim 1, wherein the refiner plate is designed for use in a conical-disk refiner.

3. The refiner plate of claim 1, wherein the at least one substantially triangular protrusion has a first angle defined by an intersection of the base and the first side and a second angle defined by an intersection of the base and the second side, and wherein the first angle and the second angle each measure between 15° and 75°.

4. The refiner plate of claim 3, wherein the first angle and the second angle each measure between 30° and 60°.

5. The refiner plate of claim 3, wherein the first angle and the second angle each measure between 40° and 50°.

6. The refiner plate segment of claim 3, wherein the first angle and the second angle are approximately equal.

7. The refiner plate of claim 1, wherein the refiner plate segment has an arc length corresponding to the inlet zone, and wherein the base of the at least one substantially triangular protrusion has a length that is 20% to 45% of the arc length.

8. The refiner plate of claim 7, wherein the base of the at least one substantially triangular protrusion has a length that is 30 to 35% of the arc length.

9. The refiner plate of claim 1, wherein at least one of the base, first side, and second side is not substantially straight.

10. The refiner plate of claim 9, wherein at least one of the base, first side, and second side is arcuate.

11. The refiner plate of claim 1, wherein the refiner plate includes an annular array of plate segments and each segment includes at least one of the substantially triangular protrusions.

12. A refiner plate for refining lignocellulosic material comprising: multiple refiner plate segments, wherein each refiner plate segment includes a refining zone and an inlet zone, wherein the inlet zone includes at least one substantially triangular protrusion consisting of a top and three sides: a base, a first side, and a second side, wherein the at least one substantially triangular protrusion is defined from an elevation view, wherein the at least one substantially triangular protrusion has a first rounded corner at a connection of the base and the first side, a second rounded corner at a connection of the base and the second side, and a third rounded corner at a connection of the first side and the second side.

13. The refiner plate of claim 12 further comprising multiple refiner plate segments designed for a conical-disk refiner.

14. The refiner plate of claim 12 further comprising multiple refiner plate segments designed for a conical refiner.

15. The refiner plate of claim 12 further comprising multiple refiner plate segments designed for a disk refiner.

16. The refiner plate of claim 12 comprising a stator refiner plate.

17. The refiner plate of claim 12 comprising a rotor refiner plate.

* * * * *